US006718893B1

(12) United States Patent
Kong

(10) Patent No.: US 6,718,893 B1
(45) Date of Patent: Apr. 13, 2004

(54) APPARATUS AND METHOD FOR CONTROLLING POSITION OF EMBROIDERY FRAME

(75) Inventor: Byoung Min Kong, Inchon (KR)

(73) Assignee: Sunstar Precision Co., Ltd., Inchon (KR)

( * ) Notice: Subject to any disclaimer, the term of this patent is extended or adjusted under 35 U.S.C. 154(b) by 0 days.

(21) Appl. No.: 10/388,640

(22) Filed: Mar. 17, 2003

(51) Int. Cl.[7] ..... D05B 21/00; D05C 9/06
(52) U.S. Cl. ..... 112/102.5; 112/220
(58) Field of Search ..... 112/102.5, 470.06, 112/220; 700/138

(56) References Cited

U.S. PATENT DOCUMENTS 4,258,636 A * 3/1981 Rolauffs et al. .... 112/470.06 X
5,074,229 A 12/1991 Sasako et al.
5,458,075 A * 10/1995 Tice et al. ..... 112/470.04
6,161,491 A 12/2000 Takenoya et al.

* cited by examiner

*Primary Examiner*—Peter Nerbun
(74) *Attorney, Agent, or Firm*—Staas & Halsey LLP

(57) ABSTRACT

Disclosed are an apparatus for controlling a position of an embroidery frame, which is capable of performing an accurate embroidering operation by feed backing a position error due to mutual operations of interlocking devices for driving the embroidery frame using a displacement sensor for sensing a displacement of the embroidery frame, and a method thereof. The apparatus comprises an X-axis driver, a Y-axis driver, a sensor and a controller. The X-axis driver moves the embroidery frame along an X-axis direction. The Y-axis driver moves the embroidery frame along a Y-axis direction. The sensor senses a displacement of the embroidery frame to the X-axis and Y-axis directions, and outputs electric signals corresponding to the sensed displacement. The controller generates X-axis and Y-axis drive control signals based on the electric signal from the sensor in order to control the X-axis and Y-axis drivers, respectively.

23 Claims, 5 Drawing Sheets

APPARATUS AND METHOD FOR CONTROLLING POSITION OF EMBROIDERY FRAME

BACKGROUND OF THE INVENTION

1. Field of the Invention

The present invention relates to an embroidery machine, and more particularly to an apparatus which accurately controls the position of an embroidery frame in an embroidery machine by sensing a displacement of the embroidery frame and feeding back an error of the sensed movement of the embroidery frame and a method thereof.

2. Description of the Prior Art

As generally known in the art, an embroidery machine embroiders an embroidery design on a fabric fixed on an embroidery frame while a needle holder contained in a sewing device moves up and down, and simultaneously, the embroidery frame moves in directions along an X-axis and a Y-axis. Because the embroidery machine embroiders the embroidery design on the fabric while the embroidery frame moves as above the X-axis and the Y-axis, accurate movement and low vibration of the embroidery frame are closely related to the quality of embroidery.

Conventionally, the embroidery machine includes an alternating current (AC) servo-motor or an induction motor for moving the needle holder up and down. Alternatively, the embroidery machine includes a stepping motor for moving the embroidery frame along the X-axis and the Y-axis.

FIG. 1 is a block diagram showing a configuration of a conventional apparatus for controlling a position of an embroidery frame in an embroidery machine. The conventional apparatus for controlling a position of an embroidery frame includes a controller 10, an X-axis driver 20, and a Y-axis driver 30.

When an external embroidery frame displacement command signal is inputted to a controller 10, the controller 10 outputs X-axis and Y-axis drive control signals corresponding to the external embroidery frame displacement command signal. The external embroidery frame displacement command signal is a signal which requests the embroidery frame 400 to move along an X-axis direction and a Y-axis direction over predetermined displacements, respectively. The X-axis driver 20 includes an X-axis servo-motor (not shown) as a driving source to move the embroidery frame 40 to the X-axis direction. The X-axis driver 20 drives the X-axis servo-motor according to the X-axis drive control signal from the controller 10. The X-axis driver 20 moves the embroidery frame 40 along an X-axis direction by means of the driven X-axis motor by a predetermined displacement. The Y-axis driver 30 includes a Y-axis servo-motor (not shown as a driving source to move the embroidery frame 40 along the Y-axis direction. The Y-axis driver 30 drives the Y-axis servo-motor according to the Y-axis drive control signal from the controller 10. The Y-axis driver 30 moves the embroidery frame 40 along a y-axis direction by means of the driven Y-axis motor by a predetermined displacement.

X-axis and Y-axis servo motors of the X-axis and Y-axis drivers 20 and 30 transmit power to interlocking devices. The interlocking devices include a driving timing pulley, a driven timing pulley, and a shaft. During transferring the powers to the interlocking devices, an error occurs due to mutual operations of the interlocking devices. The error prevents the controller 10 from accurately controlling the position of the embroidery frame 40, causing a lowering of the quality of embroidery.

In order to solve the above problems, a power transmission method using a linear motor instead of the timing belt has been suggested. However, the power transmission method should have a plurality of linear motors and drivers for controlling a plurality of linear motors. This increases the manufacturing cost. Furthermore, since a plurality of linear motors should move the embroidery frame 20 in the same direction, there is a technical difficulty of synchronizing them.

SUMMARY OF THE INVENTION

Accordingly, the present invention has been made to solve the above-mentioned problems occurring in the prior art, and an object of the present invention is to provide an apparatus for controlling a position of an embroidery frame, which is capable of performing an accurate embroidering operation by feeding back a position error due to mutual operations of interlocking devices for driving the embroidery frame using a displacement sensor for sensing a displacement of the embroidery frame, and a method thereof.

In order to accomplish this object, there is provided an apparatus for controlling a position of an embroidery frame in an embroidery machine, the embroidery machine having the embroidery frame for fixing a fabric, the apparatus comprising: a X-axis driver for moving the embroidery frame along an X-axis direction; a Y-axis driver for moving the embroidery frame along a Y-axis direction; a sensor for sensing a displacement of the embroidery frame along the X-axis and Y-axis directions, and outputting electric signals corresponding to the sensed displacement of the embroidery frame; and a controller for generating X-axis and Y-axis drive control signals based on the electric signals from the sensor in order to control the X-axis and Y-axis drivers, respectively.

Preferably, the controller includes a position detector for detecting the displacement of the embroidery frame based on the electric signals from the sensor; a speed detector for detecting a transport speed of the embroidery frame based on the displacement of the embroidery frame sensed by the sensor; and a current detector for detecting the first and second motor drive current signals provided from the X-axis and Y-axis drivers, wherein the controller generates the X-axis and Y-axis drive control signals using the displacement of the embroidery frame detected by the position detector, the transport speed of the embroidery frame detected by the speed detector, and the motor drive current signals detected by the current detector.

Preferably, the position detector includes a counter for counting the pulse number of the electric signals from the sensor, and the position detector detects the displacement of the embroidery frame along the X-axis and Y-axis directions based on the pulse number of the electric signal counted by the counter, and the speed detector detects the transport speed of the embroidery frame based on the number of the electric signal counted by the counter.

Preferably, the controller includes a first calculator for calculating a position error based on the displacement of the embroidery frame detected by the position detector and the displacement by an external embroidery frame displacement command signal; a position controller for generating a speed control signal based on the position error calculated by the first calculator; a second calculator for calculating a speed error based on the speed control signal from the position controller and the transport speed of the embroidery frame detected by the speed detector; a speed controller for generating a current control signal based on the speed error calculated by the second calculator; a third calculator for calculating an error of a driving current based on the current control signal generated by the speed controller and the current signal detected by the current detector; and a current controller for generating a drive control signal based on the error of a driving current calculated by the third calculator.

Also, the sensor is installed at a predetermined X-axis position of the embroidery frame. Further, the sensor is installed at a predetermined Y-axis position of the embroidery frame. The sensor comprises a displacement sensor. The displacement sensor outputs an electric signal which corresponds to the displacement sensed by the sensor in a linear scale fashion.

There is also provided a method for controlling a position of an embroidery frame which moves the position of the embroidery frame along X-axis and Y-axis directions according to X-axis and Y-axis drive control signals from the X-axis and Y axis drivers, the method comprising the steps of: (i) detecting an electric signal corresponding to a displacement after moving the embroidery frame along an X-axis and a Y-axis; and (ii) generating the X-axis and Y-axis drive control signals based on the electric signal detected in step (i).

Preferably, step (ii) includes the steps of: (ii-1) detecting the displacement of the embroidery frame based on the electric signal detected in step (i); (ii-2) detecting a transfer speed of the embroidery frame based on the displacement of the embroidery frame detected in step (ii-1); (ii-3) detecting motor drive current signals which the X-axis and Y-axis drivers output; and (ii-4) generating the X-axis and Y-axis drive control signals using the displacement of the embroidery frame detected in step (ii-1), the transfer speed of the embroidery frame detected in step (ii-2), and the motor drive current signals detected in step (ii-3).

Preferably, step (ii-1) includes the step of counting the pulse number of the detected electric signal, and the method detects a displacement and a transfer speed of the embroidery frame to the X-axis and Y-axis directions based on the pulse number.

Preferably, step (ii-4) includes the steps of: (ii-4-1) calculating a position error based on the displacement of the embroidery frame detected in step (ii-1) and an embroidery frame displacement command signal from the external; (ii-4-2) generating a speed control signal based on the position error calculated in step (ii-4-1); (ii-4-3) calculating a speed error based on the speed control signal generated in step (ii-4-2) and the transport speed of the embroidery frame detected in step (ii-2); (ii-4-4) generating a current control signal based on the speed error calculated in step (ii-4-3); (ii-4-5) calculating an error of a driving current based on the current control signal generated in step (ii-4-4) and the motor drive current signals detected in step (ii-3); and (ii-4-6) generating a drive control signal based on the error of a driving current calculated in step (ii-4-5). Also, step (ii-1) is performed in a linear scale fashion.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
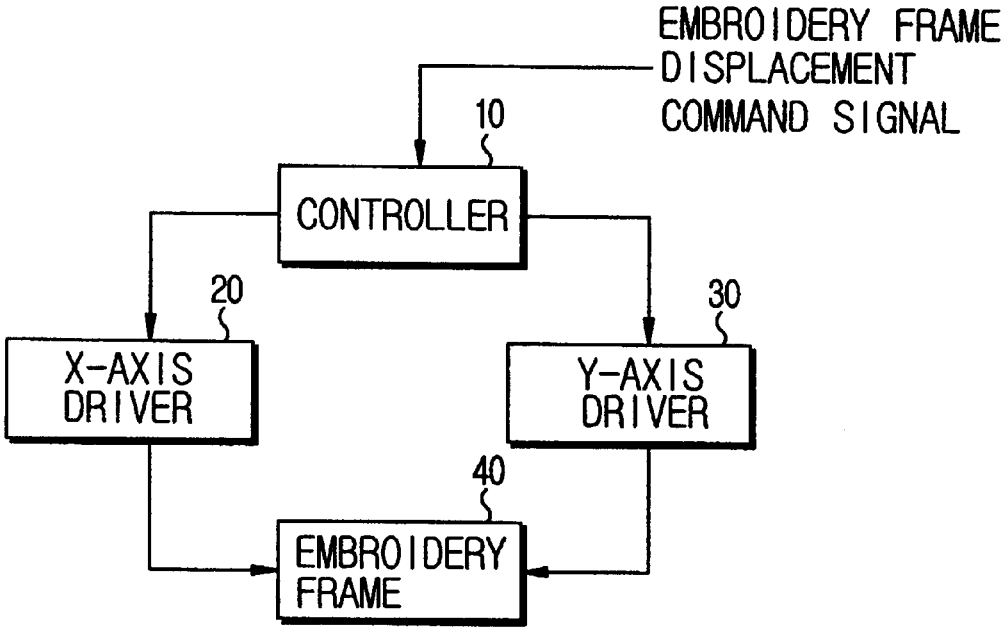
FIG. 1 PRIOR ART
FIG. 1 is a block diagram showing a configuration of a conventional apparatus for controlling a position of an embroidery frame in an embroidery machine.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
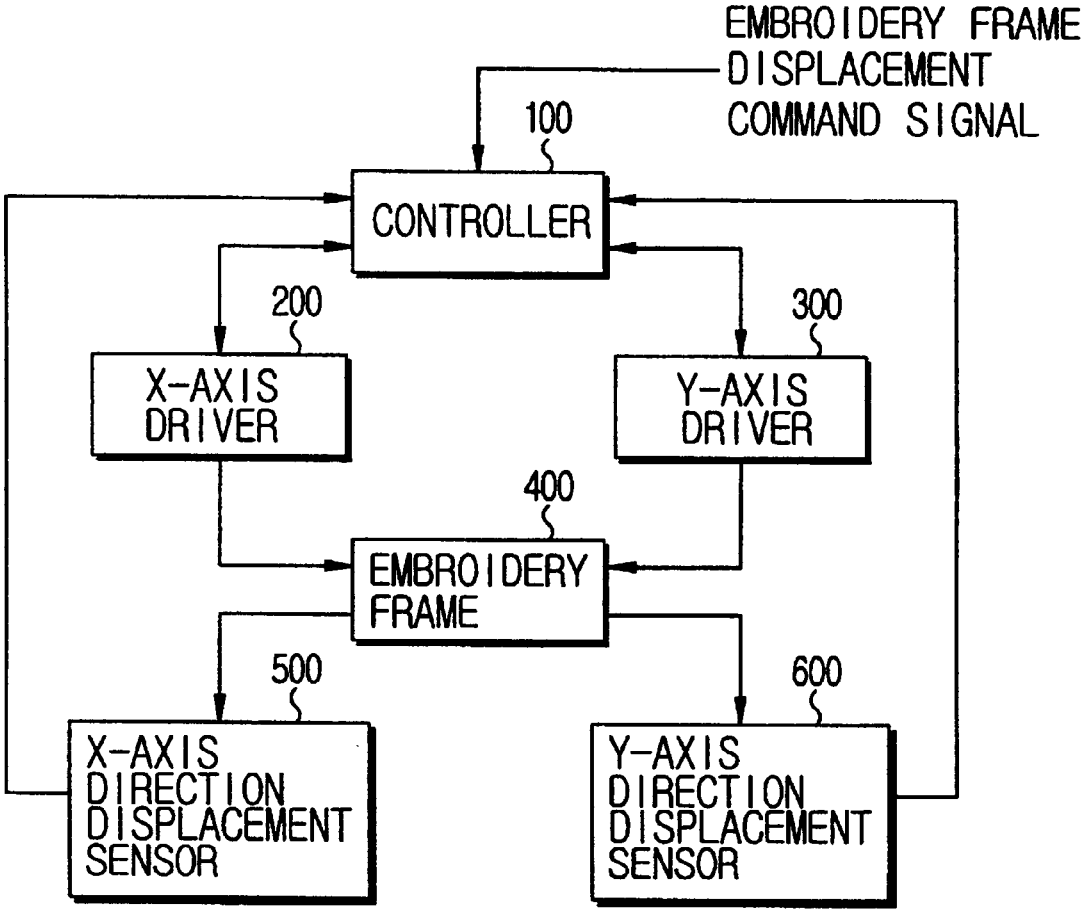
FIG. 2 is a block diagram showing a configuration of an apparatus for controlling a position of an embroidery frame in an embroidery machine according to an embodiment of the present invention.

FIG. 2 is a block diagram showing a configuration of an apparatus for controlling a position of an embroidery frame in an embroidery machine according to an embodiment of the present invention. The apparatus for controlling a position of an embroidery frame in an embroidery machine with the embroidery frame 400 for fixing a fabric includes an X-axis driver 200, a Y-axis driver 300, an X-axis direction displacement sensor 500, a Y-axis direction displacement sensor 600, and a controller 100.

The X-axis driver 200 generates a first motor drive current signal in order to move the embroidery frame 400 along an X-axis direction. The X-axis driver 200 includes an X-axis servo-motor (not shown) as a driving source to move the embroidery frame 400 along an X-axis direction.

The Y-axis driver 300 generates a second motor drive current signal in order to move the embroidery frame 400 along a Y-axis direction. The Y-axis driver 300 includes a Y-axis servo-motor (not shown) as a driving source to move the embroidery frame 400 along a Y-axis direction.

The X-axis direction displacement sensor 500 senses a displacement of the embroidery frame 400 along an X-axis direction and outputs an electric signal corresponding to the sensed displacement of the embroidery frame 400. The X-axis direction displacement sensor 500 is installed at a predetermined X-axis position of the embroidery frame 400.

The Y-axis direction displacement sensor 600 senses a displacement of the embroidery frame 400 along a Y-axis direction and outputs an electric signal corresponding to the sensed displacement of the embroidery frame 400. The Y-axis direction displacement sensor 600 is installed at a predetermined Y-axis position of the embroidery frame 400.

The X-axis and Y-axis direction displacement sensors 500 and 600 each includes a displacement sensor. The displacement sensor outputs an electric signal, which corresponds, to the displacement sensed by the X-axis and Y-axis direction displacement sensors 500 and 600 in a linear scale fashion.

As a result, the controller 100 generates and outputs X-axis and Y-axis drive control signals based on the electric signals from the X-axis and Y-axis direction displacement sensors 500 and 600, and an external embroidery frame displacement command signal from in order to control the X-axis and Y-axis drivers 200 and 300, respectively.

Figure 3:
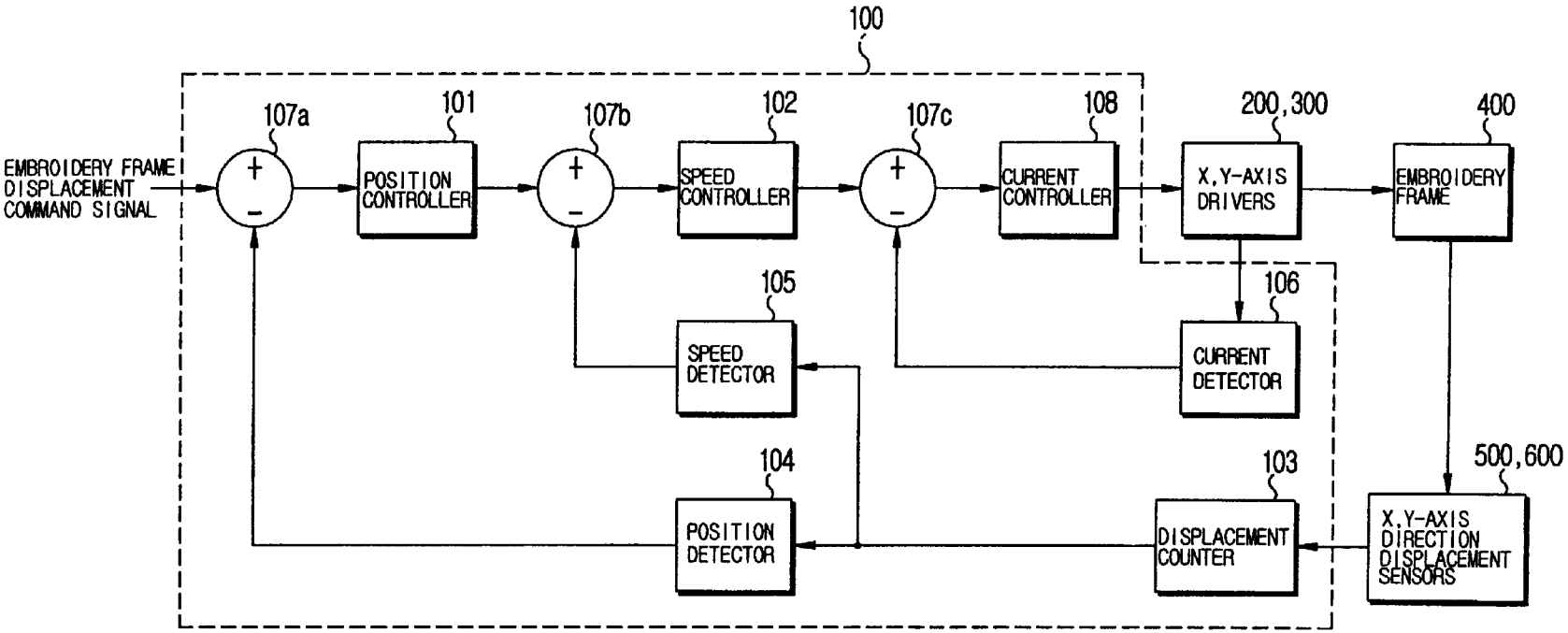
FIG. 3 is a block diagram of details of the apparatus for controlling a position of an embroidery frame shown in FIG. 2.

FIG. 3 is a block diagram of details of the apparatus for controlling a position of an embroidery frame shown in FIG. 2. As shown in FIG. 3, the controller 100 includes a displacement counter, a position detector 104, a speed detector 105, a current detector 106, a first calculator 107*a*, a position controller 101, a second calculator 107*b*, a speed controller 102, a third calculator 107*c*, and a current controller 108.

The displacement counter 103 counts the pulse number of electrical signal output from the X-axis and Y-axis direction displacement sensors 500 and 600.

The position detector 104 detects the displacement of the embroidery frame 400 along the X-axis and the Y-axis based on the pulse number of the electric signal counted by the counter 103.

The speed detector 105 detects a transport speed of the embroidery frame 400 based on the pulse number of the electric signal counted by the counter 103.

The current detector 106 detects the first and second motor drive current signals provided from the X-axis and Y-axis drivers 200 and 300.

The first calculator 107*a* calculates a position error based on the displacement of the embroidery frame 400 detected by the position detector 104 and the displacement by the embroidery frame displacement command signal from the external.

The position controller 101 generates and outputs a speed control signal based on the position error calculated by the first calculator 107*a*.

The second calculator 107*b* calculates a speed error based on the speed control signal from the position controller 101 and the transport speed of the embroidery frame 400 detected by the speed detector 105.

The speed controller 102 generates and outputs a current control signal based on the speed error calculated by the second calculator 107*b*.

The first calculator 107*a* calculates a position error based on the displacement of the embroidery frame 400 detected by the position detector 104 and a displacement indicated by the external embroidery frame displacement command signal.

The current controller 108 generates and outputs a drive control signal based on the error of a driving current calculated by the third calculator 107*c* to the X-axis and Y-axis drivers 200 and 300.

Figure 4:
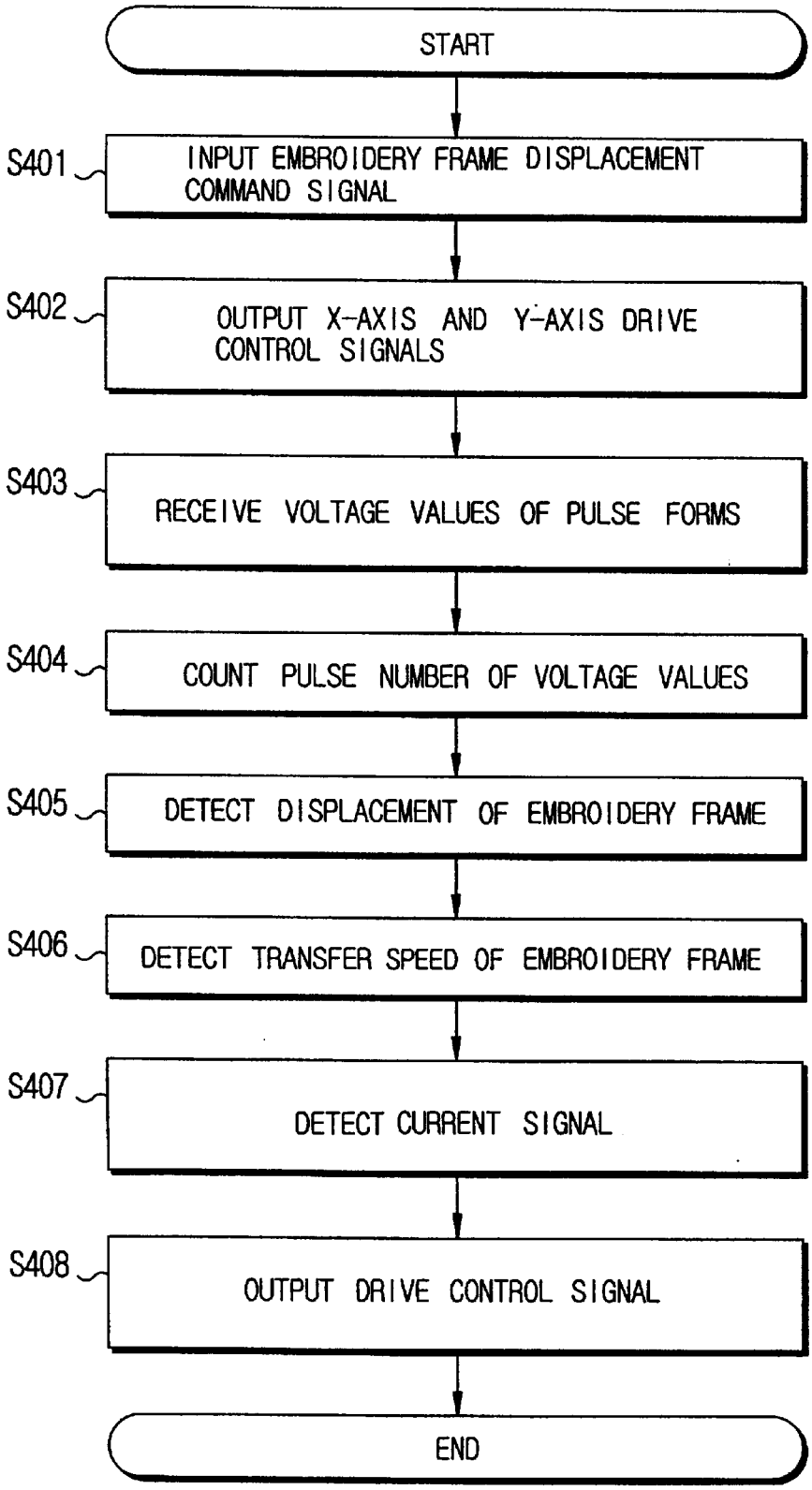
FIG. 4 is a flow chart which illustrates a method for controlling a position of an embroidery frame in an embroidery machine according to an embodiment of the present invention.

Hereinafter, an apparatus and a method for controlling a position of an embroidery frame in an embroidery machine according to an embodiment of the present invention will be described with reference to FIG. 4. FIG. 4 is a flow chart which illustrates a method for controlling a position of an embroidery frame in an embroidery machine according to an embodiment of the present invention.

In step S401, an external embroidery frame displacement command signal is inputted to a controller 100. The external embroidery frame displacement command signal is a signal which requests a position of the embroidery frame 400 to move along an X-axis direction and a Y-axis direction by 10 mm and 20 mm, respectively.

The controller 100 outputs X-axis and Y-axis drive control signals according to the external input embroidery frame displacement command signal to the X-axis driver 200 and the Y-axis driver 300, respectively (step S402). As X-axis and Y-axis servo motors (not shown) of the X-axis and Y-axis drivers 200 and 300 transmit power to interlocking devices of the X-axis and Y-axis drivers 200 and 300, the embroidery frame 400 moves along the X-axis and Y-axis directions and the X-axis and Y-axis direction displacement sensors 500 and 600 sense a displacement of the embroidery frame 400. The interlocking devices include a driving timing pulley, a driven timing pulley, a shaft, and so on. Preferably, each of the X-axis and Y-axis direction displacement sensors 500 and 600 is a displacement sensor. More preferably, each of the X-axis and Y-axis direction displacement sensors 500 and 600 is a displacement sensor which operates in a linear scale fashion.

Figure 5:
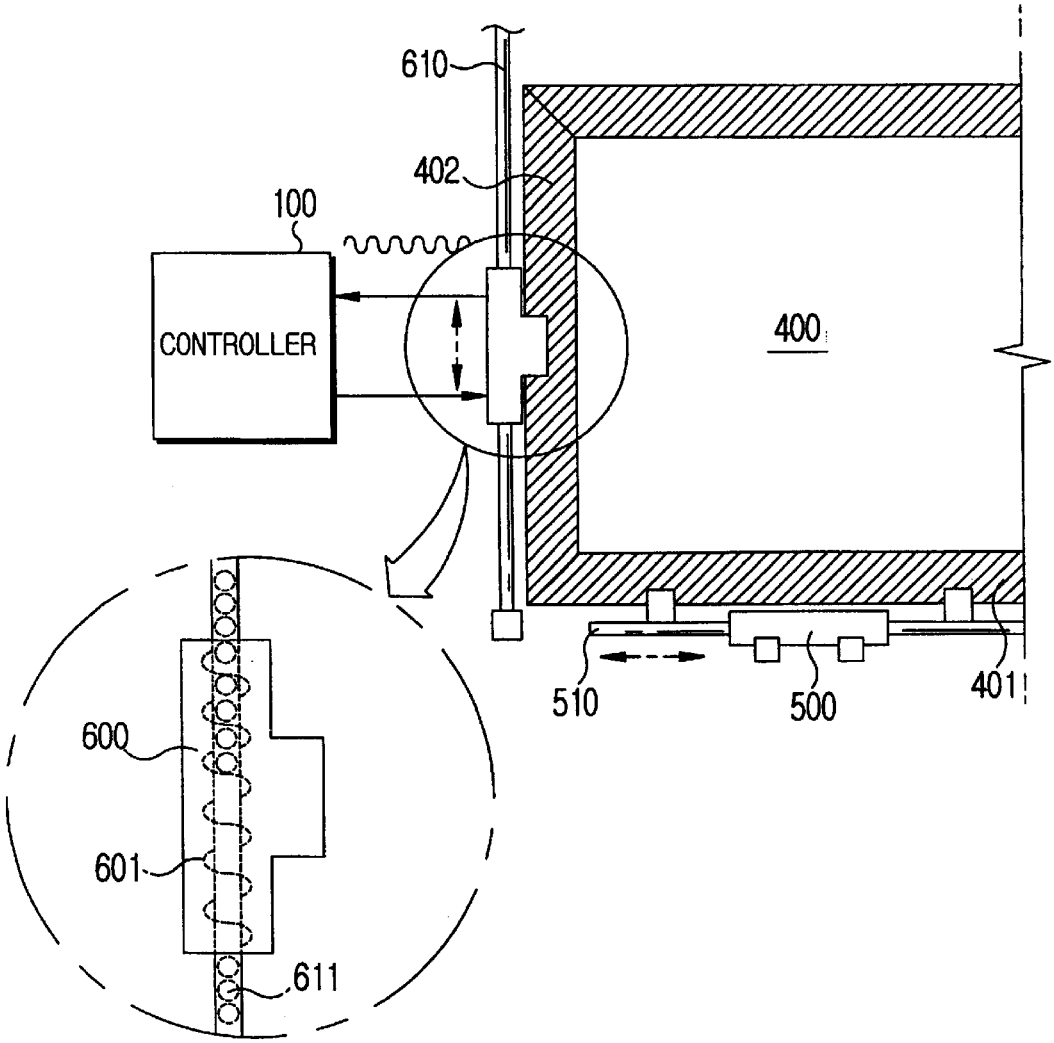
FIG. 5 is a view for illustrating a displacement sensing operation of an embroidery frame by X-axis and Y-axis direction displacement sensors.

A method is provided herein for sensing a displacement of the embroidery frame 400 in a linear scale fashion referring to FIG. 5. FIG. 5 is a view which illustrates a displacement sensing operation of an embroidery frame 400 by X-axis and Y-axis direction displacement sensors 500 and 600. As shown in FIG. 5, the X-axis direction displacement sensor 500 and an X-axis scale 510 are installed along an X-axis direction. In the X-axis direction, the X-axis scale 510 is attached to an X-axis frame 401 of the embroidery frame 400. The X-axis direction displacement sensor 500 is fixed to the embroidery machine to measure the displacement of the X-axis scale 510. Accordingly, when the embroidery frame 400 moves in the X-axis direction, the X-axis direction displacement sensor 500 is maintained in a fixed state and the X-axis scale 510 moves in the X-axis direction together with the embroidery frame 400. On the other hand, the Y-axis direction displacement sensor 600 and a Y-axis scale 610 are installed along a Y-axis direction. The Y-axis direction displacement sensor 600 and the Y-axis scale 610 measure the Y-axis displacement of the embroidery frame 400. In the Y-axis direction, the Y-axis direction displacement sensor 600 is attached to the Y-axis frame 402 of the embroidery frame 400, and the scale 610 is fixed to the embroidery machine to measure the displacement of the Y-axis direction displacement sensor 600. Accordingly, when the embroidery frame 400 moves in the Y-axis direction, the Y-axis direction scale 610 is maintained in a fixed state and the Y-axis direction displacement sensor 600 moves in the Y-axis direction together with the embroidery frame 400.

However, scales 510 and 610 can be attached to X-axis and Y-axis frames 401 and 402 of the embroidery frame 400, respectively. In this case, when the embroidery frame 400 moves in the X-axis and Y-axis directions, the X-axis and Y-axis scales 510 and 610 move in the X-axis and Y-axis directions together with the embroidery frame 400. Alternatively, the X-axis and Y-axis direction displacement sensors 500 and 600 can be attached to frames 401 and 402 of the embroidery frame 400, respectively. In this case when the embroidery frame 400 moves in the X-axis and Y-axis directions and the X-axis and Y-axis direction displacement sensors 500 and 600 move in the X-axis and Y-axis directions together with the embroidery frame 400. In case that either the X-axis and Y-axis direction displacement sensors 500 and 600 or scales 401 and 402 are attached to X-axis and Y-axis X-axis and Y-axis frames 401 and 402 of the embroidery frame 400, respectively, displacement sensing operation by the X-axis and Y-axis direction displacement sensors 500 and 600 can be performed on the same manner.

As shown FIG. 5, a coil 601 is provided with the inside of the Y-axis direction displacement sensor which is attached to the Y-axis frame 402 of the embroidery frame 400. A plurality of bearings 611 are arranged in a line at the inside of the scale 610.

Accordingly, when the Y-axis direction displacement sensor 600 is guided in the Y-axis direction along the Y-axis scale 610 by the power provided from the Y-axis driver 300, the controller 100 applies an electric source to the Y-axis direction displacement sensor 600. Consequently, a current having a predetermined amplitude flows through the coil 601 to form a magnetic field. In the state, a plurality of bearings 611 sequentially pass through the coil 601 of the Y-axis direction displacement sensor 600 which is guided in the Y-axis direction along the Y-axis scale 610. Accordingly the controller 100 receives the first voltage value of a pulse form from the Y-axis direction displacement sensor 500 which corresponds to a phase difference between currents flowing through the coil 601 before and after the embroidery frame 400 moves along the Y-axis direction. Similarly, the controller 100 receives the second voltage value of a pulse form from the Y-axis direction displacement sensor 600 which corresponds to a phase difference of currents flowing through the coil 601 before and after the embroidery frame 400 moves in the Y-axis direction (step S403).

When the first and second voltage values are applied to the displacement counter 103 of the controller 100, the displacement counter 103 counts the pulse numbers of the first and second voltage values, respectively (step S404).

In order to compensate for a position of the embroidery frame 400 according to the pulse numbers of the first and second voltage values counted by the displacement counter 103, structural elements of the controller 100 operate in a Proportioning-Integral-Derivation (Referred to as "PID" hereinafter) control principle. Since the PID control principle is known, a description thereof is omitted.

The counted pulse numbers of the first and second voltage values are inputted to the position detector 104 and the speed detector 105, respectively, and the position detector 104 continues to detect a displacement of the embroidery frame 400 to an X-axis direction and a Y-axis direction (step S405). The first calculator 107*a* calculates a position error by calculating the displacement of the embroidery frame 400 detected by the position detector 104 and the displacement of the embroidery frame displacement command signal inputted to the controller 100 in step S401. The speed detector 105 detects a transport speed of the embroidery frame 400 which corresponds to the pulse numbers of the first and second voltage values counted by the displacement counter 103 (step S406).

When the position controller 101 generates and outputs a speed control signal based on the position error calculated by the first calculator 107*a*, and the second calculator 107*b* calculates a speed error based on the speed control sign al from the position controller 101 and the transport speed of the embroidery frame 400 detected by the speed detector 105, the speed controller 102 generates a current control signal based on the speed error calculated by the second calculator 107*b*.

When the current detector 106 detects the current signals in proportion to drive current signals of X-axis and Y-axis servo motors provided from the X-axis and Y-axis drivers 200 and 300 (step S407), the third calculator 107*c* calculates an error of a driving current by calculating the current control signal generated by the speed controller 102 and the current signal detected by the current detector 106. The current controller 108 outputs a drive control signal to the X-axis and Y-axis drivers 200 and 300 based on the error of a driving current calculated by the third calculator 107*c* (step S408). The X-axis and Y-axis drivers 200 and 300 controls to compensate for a position of the embroidery frame 400 by an error of the displacement while moving the embroidery frame 400 in the X-axis direction and the Y-axis direction.

As mentioned above, the present invention minimizes an error of a displacement occurring due to mutual operations of interlocking devices during a power transmission, by sensing a displacement of the embroidery frame 400 to X-axis and Y-axis directions by displacement sensors and controlling a position of the embroidery frame based on the sensed displacement of the embroidery frame 400. Also, the present invention reduces the manufacturing costs in comparison with a conventional method using linear motors as a power transmission means. Further, the present invention compensates for an error of a displacement which occurs in a corresponding driving source regardless of the kind of X-axis and Y-axis driving source (X-axis and Y-axis servomotors are used in the present invention), even when a stepping motor or a linear motor is used, by sensing a displacement of the embroidery frame 400 to X-axis and Y-axis directions. Accordingly, the present invention can accurately perform a position control of the embroidery frame 400 in order to maximize the quality of embroidery.

Although a preferred embodiment of the present invention has been described for illustrative purposes, those skilled in the art will appreciate that various modifications, additions and substitutions are possible, without departing from the scope and spirit of the present invention as disclosed in the accompanying claims. The present invention has been described with reference to an embroidery frame. However, it is to be noted that the present invention is in no way limited to the embroidery frame. It is understood that the present invention is also applicable to a sewing machine.

What is claimed is:

1. An apparatus to control a position of an embroidery frame in an embroidery machine, the embroidery machine having the embroidery frame to fix a fabric, the apparatus comprising:

an X-axis driver to move the embroidery frame along an X-axis direction;

a Y-axis driver to move the embroidery frame along a Y-axis direction;

a sensor to sense a displacement of the embroidery frame to the X-axis and Y-axis directions, and outputting electric signals corresponding to the sensed displacement of the embroidery frame; and a controller to generate X-axis and Y-axis drive control signals based on the electric signals from the sensor in order to control the X-axis and Y-axis drivers, respectively.

2. The apparatus as recited in claim 1, wherein the controller includes:

a position detector to detect the displacement of the embroidery frame based on the electric signals from the sensor;

a speed detector to detect a transport speed of the embroidery frame based on the displacement of the embroidery frame sensed by the sensor; and a current detector to detect first and second motor drive current signals provided from the X-axis and Y-axis drivers, wherein the controller generates the X-axis and Y-axis drive control signals using the displacement of the embroidery frame detected by the position detector, the transport speed of the embroidery frame detected by the speed detector, and the first and second motor drive current signals detected by the current detector.

3. The apparatus as recited in claim 2, wherein:

the position detector includes a counter to count a pulse number of the electric signal from the sensor, and the position detector detects the displacement of the embroidery frame along the X-axis and Y-axis directions based on the pulse number of the electric signal counted by the counter, and the speed detector detects the transport speed of the embroidery frame based on the pulse number of the electric signal counted by the counter.

4. The apparatus as recited in claim 2, wherein the controller includes:

a first calculator to calculate a position error based on the displacement of the embroidery frame detected by the position detector and a displacement indicated by the embroidery frame displacement command signal;

a position controller to generate a speed control signal based on the position error calculated by the first calculator;

a second calculator to calculate a speed error based on the speed control signal from the position controller and the transport speed of the embroidery frame detected by the speed detector;

a speed controller to generate a current control signal based on the speed error calculated by the second calculator;

a third calculator to calculate an error of a driving current based on the current control signal generated by the speed controller and the current signal detected by the current detector; and a current controller to generate a drive control signal based on the error of a driving current calculated by the third calculator.

5. The apparatus as recited in claim 3, wherein the controller includes:

a first calculator to calculate a position error based on the displacement of the embroidery frame detected by the position detector and a displacement indicated by an external embroidery fume displacement command signal;

a position controller to generate a speed control signal based on the position error calculated by the first calculator;

a second calculator to calculate a speed error based on the speed control signal from the position controller and the transport speed of the embroidery frame detected by the speed detector;

a speed controller to generate a current control signal based on the speed error calculated by the second calculator;

a third calculator to calculate an error of a driving current based on the current control signal generated by the speed controller and the current signal detected by the current detector; and a current controller to generate a drive control signal based on the error of the driving current calculated by the third calculator.

6. The apparatus as recited in claim 1, wherein the sensor is respectively installed at predetermined X-axis and Y-axis positions of the embroidery frame.

7. The apparatus as recited in claim 1, wherein the sensor comprises a displacement sensor.

8. The apparatus as recited in claim 7, wherein the displacement sensor outputs an electric signal which corresponds to the displacement sensed by the sensor in a linear scale fashion.

9. A method to control a position of an embroidery frame which moves the position of the embroidery frame along X-axis and Y-axis directions according to X-axis and Y-axis drive control signals from X-axis and Y-axis drivers, the method comprising:

detecting an electric signal corresponding to a displacement after moving the embroidery frame along an X-axis and a Y-axis; and generating the X-axis and Y-axis drive control signals based on the electric signal detected.

10. The method as defined in claim 9, wherein generating the X-axis and Y-axis device control signals based on the electric signal detected includes:

detecting the displacement of the embroidery frame based on the electric signal detected;

detecting a transfer speed of the embroidery frame based on the displacement of the embroidery frame detected;

detecting motor drive current signals which the X-axis and Y-axis drivers output; and generating the X-axis and Y-axis drive control signals using the displacement of the embroidery frame detected, the transfer speed of the embroidery frame detected, and the motor drive current signals detected.

11. The method of claim 10, wherein detecting the displacement of the embroidery frame based on the electric signal detected includes counting the pulse number of the detected electric signal, and detecting a displacement and a transfer speed of the embroidery frame to the X-axis and Y-axis directions based on the pulse number.

12. The method as defined of claim 10, wherein generating the X-axis and Y-axis drive control signals using the displacement of the embroidery frame detected, the transfer speed of the embroidery frame detected, and the motor drive current signals detected includes:

calculating a position error based on the displacement of the embroidery frame detected and a displacement indicated by an external embroidery frame displacement command signal;

generating a speed control signal based on the position error calculated;

calculating a speed error based on the speed control signal generated and the transport speed of the embroidery frame detected;

generating a current control signal based on the speed error calculated;

calculating an error of a driving current based on the current control signal generated and the motor drive current signals detected; and generating a drive control signal-based on the error of the driving current calculated.

13. The method of claim 10, wherein generating the X-axis and Y-axis drive control signals using the displacement of the embroidery frame detected, the transfer speed of the embroidery frame detected, and the motor drive current signals detected includes:

calculating a position error based on the displacement of the embroidery frame detected and a displacement indicated by an external embroidery frame displacement command signal;

generating a speed control signal based on the position error calculated;

calculating a speed error based on the speed control signal generated and the transport speed of the embroidery frame detected;

generating a current control signal based on the speed error calculated;

calculating an error of a driving current based on the current control signal generated and the motor drive current signals detected; and generating a drive control signal based on the error of a driving current calculated.

14. The method of claim 9, wherein detecting the displacement of the embroidery frame based on the electric signal detected is performed in a linear scale fashion.

15. An apparatus to control a position of an embroidery frame in an embroidery machine, the embroidery machine having the embroidery frame to fix a fabric, the apparatus comprising:

an X-axis driver to move the embroidery frame along an X-axis direction;

a Y-axis driver to move the embroidery frame along a Y-axis direction;

a sensor to sense a displacement of the embroidery frame to the X-axis and Y-axis directions, and outputting electric signals corresponding to the sensed displacement of the embroidery frame; and a controller to generate X-axis and Y-axis drive control signals based on the electric signals from the sensor in order to control the X-axis and Y-axis drivers, respectively, wherein the controller includes:

a position detector to detect the displacement of the embroidery frame based on the electric signals from the sensor;

a speed detector to detect a transport speed of the embroidery frame based on the displacement of the embroidery frame sensed by the sensor; and a current detector to detect first and second motor drive current signals provided from the X-axis and Y-axis drivers, wherein the controller generates the X-axis and Y-axis drive control signals using the displacement of the embroidery frame detected by the position detector, the transport speed of the embroidery frame detected by the speed detector, and the first and second motor drive current signals detected by the current detector.

16. The apparatus as recited in claim 15, wherein:

the position detector includes a counter to count a pulse number of the electric signal from the sensor, and the position detector detects the displacement of the embroidery frame along the X-axis and Y-axis directions based on the pulse number of the electric signal counted by the counter, and the speed detector detects the transport speed of the embroidery frame based on the pulse number of the electric signal counted by the counter.

17. The apparatus as recited in claim 15, wherein the controller includes:

a first calculator to calculate a position error based on the displacement of the embroidery frame detected by the position detector and a displacement indicated by the embroidery frame displacement command signal;

a position controller to generate a speed control signal based on the position error calculated by the first calculator;

a second calculator to calculate a speed error based on the speed control signal from the position controller and the transport speed of the embroidery frame detected by the speed detector;

a speed controller to generate a current control signal based on the speed error calculated by the second calculator;

a third calculator to calculate an error of a driving current based on the current control signal generated by the speed controller and the current signal detected by the current detector; and a current controller to generate a drive control signal based on the error of a driving current calculated by the third calculator.

18. The apparatus as recited in claim 16, wherein the controller includes:

a first calculator to calculate a position error based on the displacement of the embroidery frame detected by the position detector and a displacement indicated by an external embroidery fume displacement command signal;

a position controller to generate a speed control signal based on the position error calculated by the first calculator;

a second calculator to calculate a speed error based on the speed control signal from the position controller and the transport speed of the embroidery frame detected by the speed detector;

a speed controller to generate a current control signal based on the speed error calculated by the second calculator;

a third calculator to calculate an error of a driving current based on the current control signal generated by the speed controller and the current signal detected by the current detector; and a current controller to generate a drive control signal based on the error of the driving current calculated by the third calculator.

19. The apparatus as recited in claim 15, wherein the sensor is respectively installed at predetermined X-axis and Y-axis positions of the embroidery frame.

20. A method to control a position of an embroidery frame which moves the position of the embroidery frame along X-axis and Y-axis directions according to X-axis and Y-axis drive control signals from X-axis and Y-axis drivers, the method comprising:

detecting an electric signal corresponding to a displacement after moving the embroidery frame along an X-axis and a Y-axis; and generating the X-axis and Y-axis drive control signals based on the electric signal detected, wherein generating the X-axis and Y-axis device control signals based on the electric signal detected includes:

detecting the displacement of the embroidery frame based on the electric signal detected;

detecting a transfer speed of the embroidery frame based on the displacement of the embroidery frame detected;

detecting motor drive current signals which the X-axis and Y-axis drivers output; and generating the X-axis and Y-axis drive control signals using the displacement of the embroidery frame detected, the transfer speed of the embroidery frame detected, and the motor drive current signals detected.

21. The method of claim 20, wherein detecting the displacement of the embroidery frame based on the electric signal detected includes counting the pulse number of the detected electric signal, and detecting a displacement and a transfer speed of the embroidery frame to the X-axis and Y-axis directions based on the pulse number.

22. The method of claim 20, wherein generating the X-axis and Y-axis drive control signals using the displacement of the embroidery frame detected, the transfer speed of the embroidery frame detected, and the motor drive current signals detected includes:

calculating a position error based on the displacement of the embroidery frame detected and a displacement indicated by an external embroidery frame displacement command signal;

generating a speed control signal based on the position error calculated;

calculating a speed error based on the speed control signal generated and the transport speed of the embroidery frame detected;

generating a current control signal based on the speed error calculated;

calculating an error of a driving current based on the current control signal generated and the motor drive current signals detected; and generating a drive control signal based on the error of the driving current calculated.

23. The method of claim 20, wherein generating the X-axis and Y-axis drive control signals using the displacement of the embroidery frame detected, the transfer speed of the embroidery frame detected, and the motor drive current signals detected includes:

calculating a position error based on the displacement of the embroidery frame detected and a displacement indicated by an external embroidery frame displacement command signal;

generating a speed control signal based on the position error calculated;

calculating a speed error based on the speed control signal generated and the transport speed of the embroidery frame detected;

generating a current control signal based on the speed error calculated;

calculating an error of a driving current based on the current control signal generated and the motor drive current signals detected; and generating a drive control signal based on the error of a driving current calculated.

* * * * *